US005913668A

United States Patent [19]

Messer

[11] Patent Number: 5,913,668

[45] Date of Patent: Jun. 22, 1999

[54] WEAPON REST

[76] Inventor: Jerry Wayne Messer, 2012 Verbena Dr., Loveland, Ohio 45140

[21] Appl. No.: 09/002,445

[22] Filed: Jan. 2, 1998

[51] Int. Cl.[6] ..... F41A 23/14; F41A 23/18

[52] U.S. Cl. ..... 42/94

[58] Field of Search ..... 42/94; 89/37.04

[56] References Cited

U.S. PATENT DOCUMENTS

| | | | |
|---|---|---|---|
| 3,225,656 | 12/1965 | Flaherty et al. | 42/94 |
| 3,327,422 | 6/1967 | Harris | 42/94 |
| 4,026,057 | 5/1977 | Cady | 42/94 |
| 4,470,216 | 9/1984 | Harris | 42/94 |
| 4,625,620 | 12/1986 | Harris | 89/37.04 |
| 4,903,425 | 2/1990 | Harris | 42/94 |
| 4,937,965 | 7/1990 | Narvaez | 42/94 |
| 5,347,740 | 9/1994 | Rather et al. | 42/94 |

*Primary Examiner*—Charles T. Jordan
*Assistant Examiner*—Denise Buckley
*Attorney, Agent, or Firm*—Neal O. Willmann

[57] ABSTRACT

This disclosure relates to a weapon rest which is characterized by its simplicity and stability. It comprises a base, a shaft, a cradle movably attached to the shaft and a tensioning means situated between the cradle and the shaft. This tensioning means imparts unparalleled stability to the cradled weapon permitting the use of scopes of extraordinary powers of magnification.

7 Claims, 1 Drawing Sheet

WEAPON REST

BACKGROUND OF THE INVENTION

This disclosure relates generally to a weapon rest or firearm support and more particularly to a rifle rest which is intended to be used primarily in the field by target shooters and small-game hunters. The weapon rest is very easily transported, assembles in seconds and provides support for weapons equipped with the most powerful magnifying scopes commercially available. It is axiomatic that weapons featuring extremely high-powered scopes have diminished applicability in many field conditions because of the support required to secure the weapon and dampen movement of the sighting mechanism. The greater the magnification of the scope, the more sensitive it is to movement; and a weapon rest constructed with a tensioning means, according to the present disclosure, will sufficiently dampen all movement transmitted to the weapon to effectively permit the use of high-powered scopes in the most inaccessible and rugged field conditions.

DESCRIPTION OF THE PRIOR ART

Sportsmen and fire-arms equipment manufacturers have, with limited success over the years, designed and constructed a variety of rifle rests and pistol holders to facilitate the accurate discharge of fire-arms under controlled and field conditions. Typical examples of these endeavors include the following devices described and set-forth in the relevant patent art.

For instance, U.S. Pat. No. 2,870,683 issued Jan. 27, 1959 to Wilson discloses using springs to bias the lower ends of movable gun supports to, in turn, urge the upper ends of said supports inwardly to hold a cradled fire-arm in a snug relationship and permit easy release of the weapon from the gun support.

U.S. Pat. No. 3,313,505 issued Apr. 11, 1967 to Petrie addressed the need or greater stability in a collapsible stand by providing a tensioning means consisting of an endless, flexible brace extending between a vertical supporting member and each of several legs of the stand.

And most relevant, perhaps, is U.S. Pat. No. 4,265,045 issued May 5, 1981 to Garbini, which describes a weapon rest having a spring-supported pressure rod disposed in a vertical tube which apparently functions to dampen the recoil of the weapon after discharge thus permitting immediate re-aiming and rapid repeat firing.

But, notwithstanding the above-described variously constructed devices, there remained, until now, a continuing need to provide sportsmen with an easily transported weapon stand that would accommodate a variety of firearms in the field and provide the support and stability necessary to enable the use of high-powered telescopes attached to those weapons. A weapon rest constructed according to the present disclosure addresses this need and fills it nicely.

SUMMARY OF THE INVENTION

Accordingly then, what is disclosed herein is a weapon rest. Typically the rest is for a high-powered rifle but, as a practical matter, the disclosed rest will accommodate all manner of weapons including pistols, crossbows, shotguns, muzzle-loaders and anything else that would benefit from being aimed and fired with extreme accuracy. In its essence, then, the disclosed weapon rest comprises: a base, a shaft supported by said base, a cradle movably attached to said shaft for holding the firearm; and a tensioning means positioned between said shaft and said cradle to stabilize said cradle.

DESCRIPTION OF THE PREFERRED EMBODIMENTS

Figure 1:
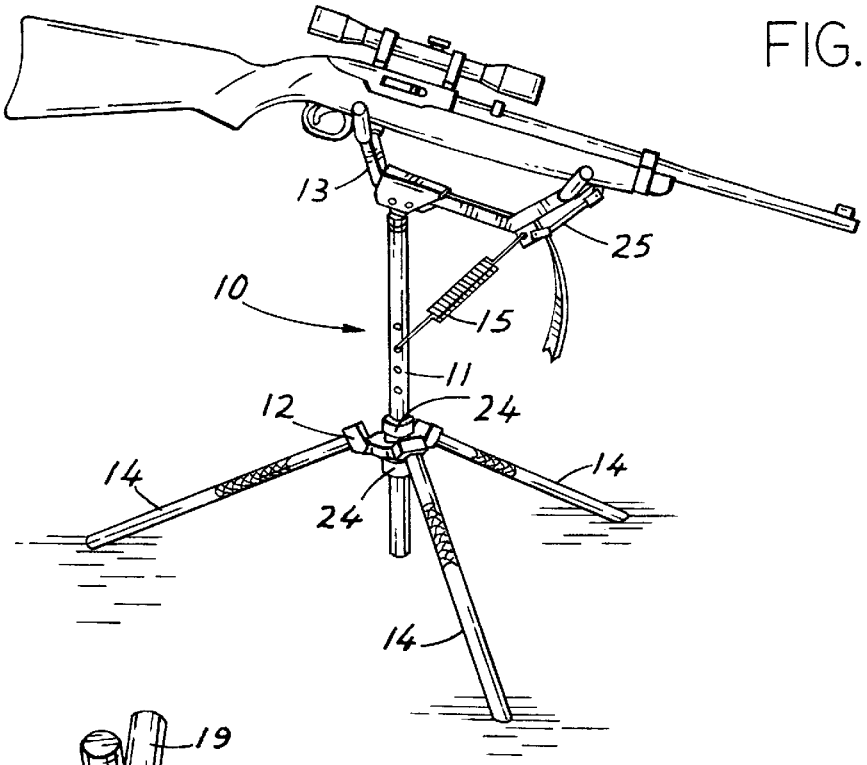
FIG. 1 is a perspective view of a weapon rest according to the disclosure supporting a rifle in firing position.

A detailed description of the disclosed weapon rest is facilitated by referring to the drawings. In particular, FIG. 1 depicts the disclosed device as a rifle rest 10 in a fully assembled and operational mode. Without a great deal of scrutiny, even the casual observer will note that the essential features of the rest 10 include the shaft 11, the base 12, the cradle 13 and the tensioning means 15.

In a preferred embodiment shown in FIG. 1, the base 12 supports the shaft 11 in a largely vertical orientation and can, itself, be further supported by a plurality of legs 14. Conveniently, a tripod arrangement has been found to present a suitable and stable means of providing additional support for the base of the weapon rest and the supported weapon in field use. In a particularly preferred embodiment of the tripod arrangement, one leg is made several inches shorter than the other two to provide added stability on hillsides and uneven terrain in general.

To enhance the portability of the weapon rest in the field, it is preferred, though certainly not required, that the legs 14 be attachable and removable from the base 12 by simply threading into mating holes in the base 12, Foldable or collapsible legs might be seen as more convenient, but such structural flexibility was found to introduce too much "play" into the weapon rest and adversely affect the stability of the cradled weapon.

Also, as depicted in the embodiment of FIG. 1, the shaft 11, can be firmly held in the base 12 by threaded nuts 24 positioned on the shaft above and below the base 12. These nuts will tighten against the base to hold the shaft 11 at an infinite number of points along the shaft to provide the desired verticle elevation of the cradled firearm. Other means for attaching the stand to the shaft have been developed and could be employed, but greater stability has been achieved with the locking nuts 24 herein described.

The primary purpose of the shaft 11 is to attach to and support the cradle 13 of the weapon rest 10. In the preferred embodiments developed thus far, the cradle 13 is attached to the shaft by employing an attachment housing 18 to enclose a portion of the cradle 13 and provide for attachment to the shaft 11.

Figure 2:
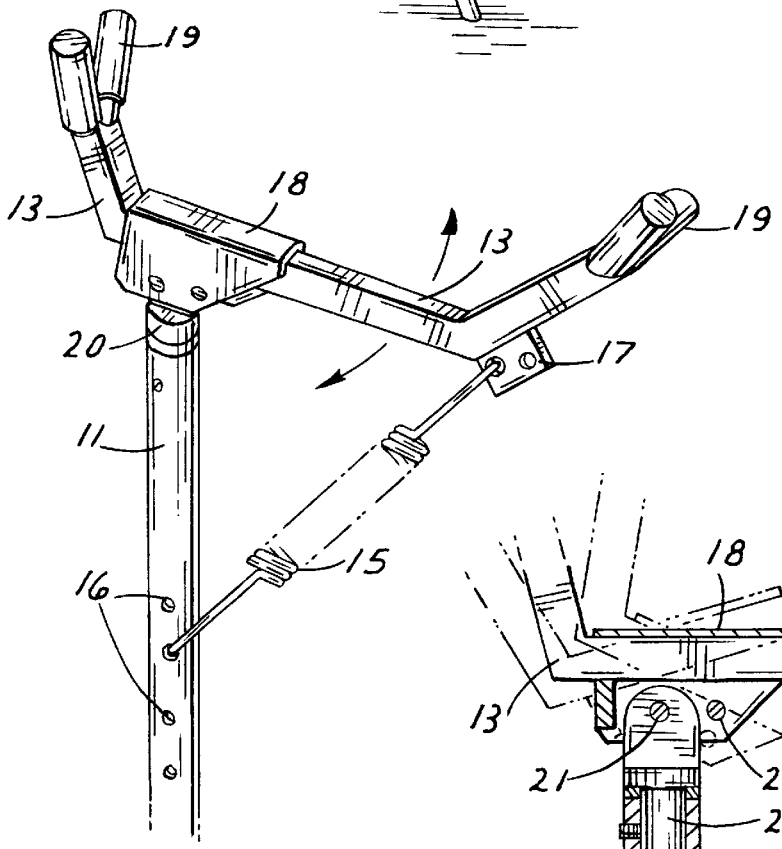
FIG. 2 is a perspective view of the disclosed weapon rest depicting a relationship between the shaft, cradle and the tensioning means.
Figure 3:
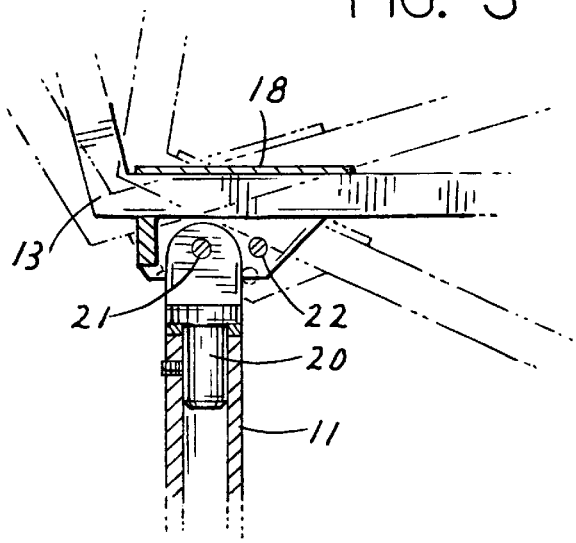
FIG. 3 is a side view of the shaft and cradle of the disclosed weapon rest depicting vertical articulation between the cradle and the shaft.

To elaborate on the preferred attachment of the cradle to the shaft, attention is directed to FIGS. 2 and 3 where a swivel head 20 is attached to the shaft 11 to provide a means for attaching the shaft to the cradle and to provide a fulcrum permitting axial movement of the cradle. The attachment housing 18, in a preferred embodiment, can be joined to the swivel head 20 by means of a pivot pin 21 which will also permit the cradle 13 to articulate with vertical movements as depicted in FIG. 3. And, like all junctures in optimal embodiments in the weapon rest described herein, the pivot pin 21 is meticulously machined to enhance the stability of the rest and accuracy of the discharged weapon. Also, to limit the vertical movement of the cradle 13, a simple stop pin 22 can be introduced into the cradle housing attachment 18 to encounter the shaft and limit declination.

While the precise design and construction of the cradle is not critical to the success of the disclosed weapon rest, a cradle equipped with paired prongs 19 at both ends of the cradle appears to work effectively in supporting or cradling a weapon such as a rifle. These prongs can be optimized by coating or covering their surfaces with a thermoplastic material to protect the surface of the weapon from scratches and scapes which would result from using an uncovered cradle.

Also apparent from FIG. 2 is the tensioning means 15 which is positioned between the shaft 11 and the cradle 13. The tensioning means is the key structural element in the disclosed weapon rest 10. It permits the marksman to introduce tension, and thereby support, on the cradle and weapon cradled therein. This tension permits the marksman to aim and accurately fire a weapon equipped with an extremely high-powered scope. Typically, the tensioning means 15 is a metal spring simply attached to the shaft and cradle by hooks positioned at both ends of the spring. However, any of a variety of tensioning means can be used to establish a tensioned relationship between the cradle 13 and the shaft 11. For example, other tensioning means can include shock cords or elastic bands. A turnbuckle has even been used, but it lacked the infinite adjustability demonstrated by the more preferred variably adjustable tensioning capability demonstrated by springs, elastic cords and belts and the like. And, with the preferred tensioning means being infinitely adjustable or movable within the range of the movement range of the tensioning means, the marksman is not unreasonably confined in any direction while drawing his bead on the target. In fact, the variable adjustment of the preferred tensioning means is intended to provide stability to the cradled weapon even while fixing the sights on a moving target.

Also the precise positioning of the tensioning means is not critical. Certainly, there is no reason a coil spring could not be positioned at the junction of the shaft and the cradle and be within the scope of this disclosure; but for now, the preferred embodiments, as depicted in the drawings, function flawlessly with the tensioning means positioned as illustrated.

The particular means of attachment of the tensioning means to either the shaft or the cradle is not critical to the disclosed invention. But a certain amount of flexibility in varying the tension manifested by the tensioning means can be realized by providing a choice of attachment locations along the shaft. For this reason, holes 16 can be provided along the shaft of the disclosed rifle rest. Similarly, an attachment means 17 is typically provided on the underside of the cradle for attaching the tensioning means to the cradle. But again, the attachment means is not critical to the success of the disclosed weapon rest arrangement. Furthermore, an enhancement of the tensioned relationship between the cradled weapon and the shaft can be achieved by connecting the weapon to the tensioned cradle. While the weapon can be held in place by the right-handed marksman's left hand, it is preferable to attach the weapon to the cradle and even more preferable to firmly attach the weapon to the cradle. Intimately linking the weapon to the tensioned cradle will enhance the effectiveness of the weapon rest and increase the accuracy of the weapon. Typically, this can be accomplished by providing some, or any, form of strapping to link the cradle and the weapon. In one embodiment of this linking, it is suggested that the cradle 13 be linked to the barrel of the fire arm. This can be achieved by providing the attachment means 17 on the cradle with an additional hole for attaching a strap 25, typically running from the sling pivot on the weapon to the cradle attachment means 17.

While the foregoing is a detailed and comprehensive description of a weapon rest having enhanced stability resulting from a tensioning means positioned between the cradle and the shaft of the rest, it should be apparent that numerous variations and modifications may also be employed to implement the spirit and purpose of this disclosure. And, therefore, this elaboration should not be assumed to limit the scope of this invention which is defined by the appended claims.

I claim:

1. A weapon rest which comprises: a base, a shaft supported by said base, a cradle for holding said weapon, said cradle movably attached to said shaft, and a spring tensioning means positioned between said cradle and the shaft to stabilize the cradle and permit the three-dimensional tensioned movement of said stabilized cradle within the range of said spring.

2. The weapon rest according to claim 1 wherein the shaft is vertically aligned.

3. The weapon rest according to claim 1 wherein the shaft can be adjusted vertically within said base.

4. The weapon rest according to claim 1 wherein the base further comprises attachable legs.

5. The weapon rest according to claim 4 wherein the attachable legs form a tripod.

6. The weapon rest according to claim 1 wherein the cradle is movably attached to said shaft to permit vertical movement of said cradle.

7. The weapon rest according to claim 1 wherein the cradle is movably attached to said shaft to permit axial rotation.

* * * * *